US005466039A

United States Patent [19]

Umbrianna

[11] Patent Number: 5,466,039

[45] Date of Patent: Nov. 14, 1995

[54] FOLDABLE LOUNGE WITH COMBINATION HEADREST AND BACKREST

[76] Inventor: Gloria J. Umbrianna, 407 W. Elm St., Pembroke, Mass. 02359

[21] Appl. No.: 209,301

[22] Filed: Mar. 14, 1994

[51] Int. Cl.[6] ..... A47C 1/14; A47C 7/54

[52] U.S. Cl. ..... 297/116; 297/115; 297/354.13; 297/411.34; 297/411.35; 297/452.63; 297/900; 5/461; 5/638

[58] Field of Search ..... 297/118, 411.25, 297/411.29, 411.31, 411.34, 411.35, 411.37, 411.38, 115, 116, 117, 452.18, 452.33, 452.63, 463, 354.13; 5/461, 638, 646

[56] References Cited

U.S. PATENT DOCUMENTS

| | | | |
|---|---|---|---|
| 1,242,593 | 10/1917 | Riddle | 5/638 X |
| 2,236,770 | 4/1941 | Atwell | 5/638 X |
| 3,874,010 | 4/1975 | Geary | 5/638 X |
| 3,897,102 | 7/1975 | Lemaire | 297/391 X |
| 5,222,779 | 6/1993 | Johnson | 5/638 X |
| 5,297,850 | 3/1994 | Gulesarian | 297/391 X |

*Primary Examiner*—Peter R. Brown

[57] ABSTRACT

A new foldable lounge for providing a portable chaise lounge with a headrest adaptable to support a recumbent prone user's face in a downward position. The head rest includes foldable armrests positionable to comfortably support the recumbent prone user's arms. The foldable lounge comprises a base portion for supporting the lower body of a user. A rectangular frame separates laterally into a seat portion and a leg rest portion. Further included are leg means whereby the frame may be elevated above and essentially parallel to a supporting surface. Also included are support means whereupon the lower body of the user may be comfortably supported. A backrest portion is provided for support, in a generally upright position, the upper body of the user seated on the base portion. The backrest portion is adaptable for supporting, in a generally horizontal position, the upper body of a supine user. The backrest portion is also adaptable for supporting, in a generally horizontal position, the face and arms of a prone user. Cushioning means are provided for relieving pressure from the back of a seated or supine user. The cushioning means are also adapted to receive the downwardly positioned face and pronated arms of a prone user.

7 Claims, 4 Drawing Sheets

FIG 1
PRIOR ART
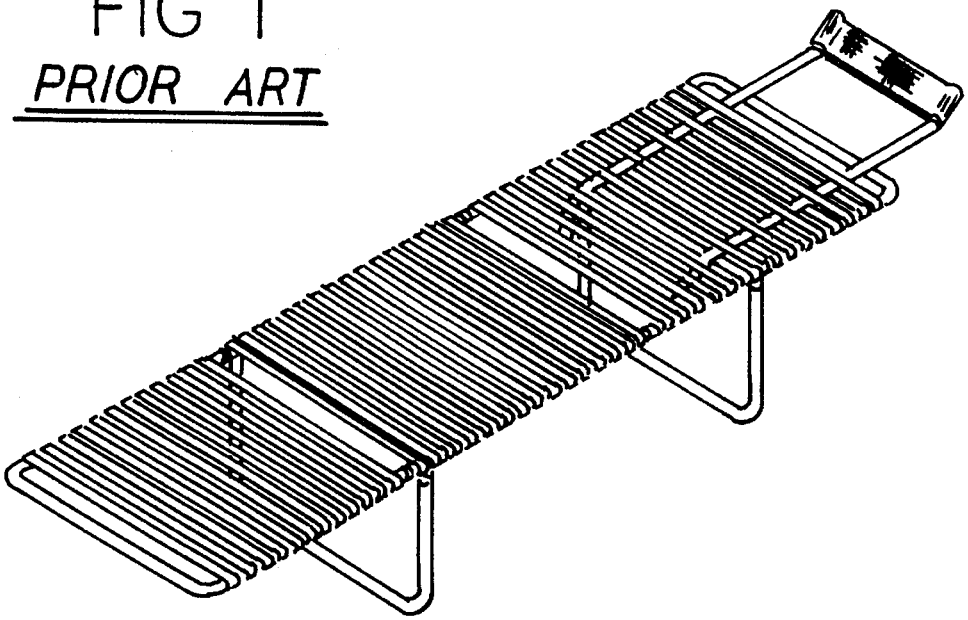
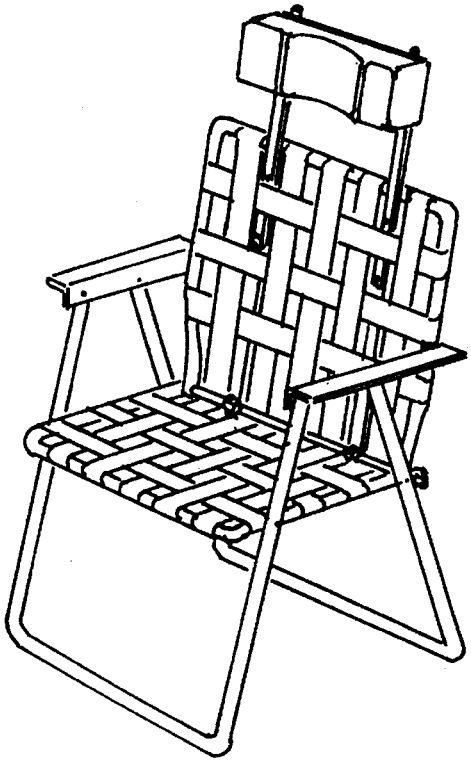
FIG 2
PRIOR ART

FIG 5
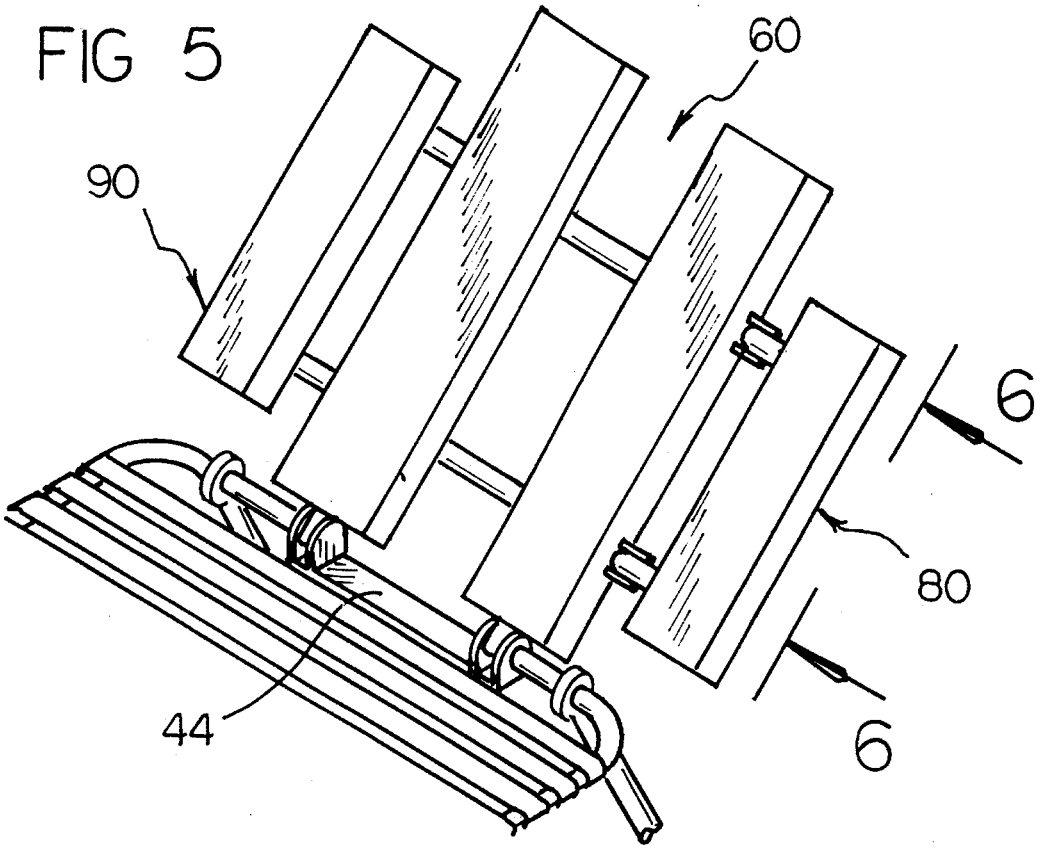
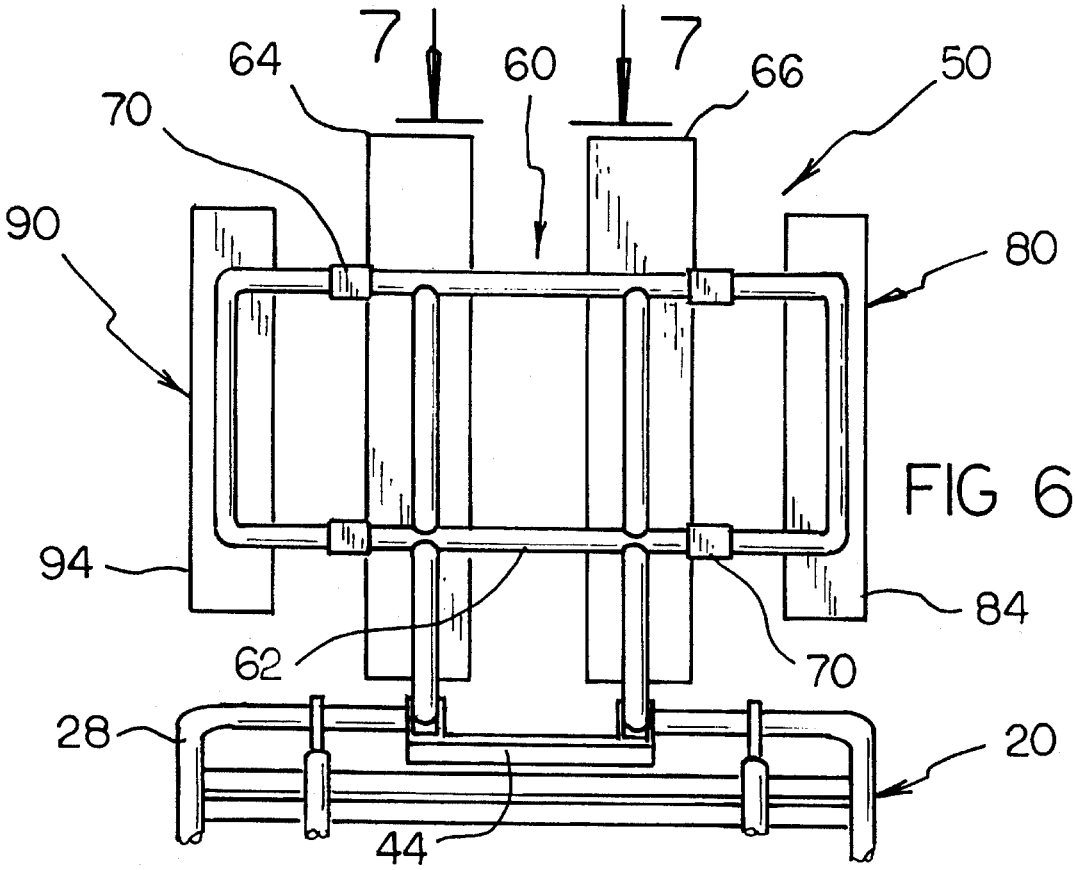
FIG 6

FOLDABLE LOUNGE WITH COMBINATION HEADREST AND BACKREST

BACKGROUND OF THE INVENTION

1. Field of the Invention

The present invention relates to lounge chairs and more particularly pertains to a foldable lounge with combination headrest and backrest which may be adapted for providing a portable chaise longue with headrest adaptable to support a recumbent prone user's face in a downward position without the necessity of turning the head uncomfortably sideways whereby the user's neck and spine remain straight without pressing the face into a backrest, the headrest additionally including foldable armrests positionable to comfortably support the recumbent prone user's arms, the headrest also being adaptable for use as a conventional adjustable backrest for sitting and recumbent supine users.

2. Description of the Prior Art

The use of lounge chairs is known in the prior art. More specifically, lounge chairs heretofore devised and utilized for the purpose of supporting a person in a sitting or recumbent position are known to consist basically of familiar, expected and obvious structural configurations, notwithstanding the myriad of designs encompassed by the crowded prior art which have been developed for the fulfillment of countless objectives and requirements.

The present invention is directed to improving devices for supporting a person in a sitting or recumbent position in a manner which is safe, secure, economical and aesthetically pleasing.

For example, U.S. Pat. No. 5,121,969 to Schroeder discloses an adjustable head rest for lounges that allows a person to lie on their stomach without the necessity of turning their head. The head rest is constructed of a frame that fits between the slats of an existing chaise lounge and is adjustable by moving the portion beneath the slats in toward or away from the lounge. The extended end of the frame has a head support in the form of a strap attached across the frame. The head support is mounted on an angle portion of the frame that provides a comfortable position to rest the forehead. The adjustable head rest described above is not a self-contained unit, having a disadvantage of requiring an already existing lounge for use. Also, the invention disclosed does not show a way to function with lounges having a woven fabric covering.

The prior art also discloses head rests as shown in U.S. Pat. No. 3,129,975 to Emery, a headrest disclosed in U.S. Pat. No. 4,030,781 to Howard, an adjustable headrest for sunbathers of U.S. Pat. No. 4,681,370 to Vancil, and a convertible seat having a foldaway headpiece described in U.S. Pat. No. 5,171,064 to Boussaroque. While these devices fulfill their respective, particular objectives and requirements, the aforementioned patents do not disclose a foldable lounge with combination headrest and backrest for providing a portable chaise longue with headrest adaptable to support a recumbent prone user's face in a downward position without the necessity of turning the head uncomfortably sideways whereby the user's neck and spine remain straight without pressing the face into a backrest. Furthermore, none of the prior art devices teach or suggest the use of foldable armrests positionable to comfortably support the recumbent prone user's arms or the headrest being adaptable for use as a conventional adjustable backrest for sitting and recumbent supine users.

In this respect, the foldable lounge with combination headrest and backrest according to the present invention substantially departs from the conventional concepts and designs of the prior art, and in so doing provides an apparatus primarily developed for the purpose of providing a portable chaise longue with headrest adaptable to support a recumbent prone user's face in a downward position without the necessity of turning the head uncomfortably sideways whereby the user's neck and spine remain straight without pressing the face into a backrest, the headrest additionally including foldable armrests positionable to comfortably support the recumbent prone user's arms, the headrest also being adaptable for use as a conventional adjustable backrest for sitting and recumbent supine users.

Therefore, it can be appreciated that there exists a continuing need for new foldable lounges with combination headrest and backrest which can be used for providing a portable chaise longue with headrest adaptable to support a recumbent prone user's face in a downward position without the necessity of turning the head uncomfortably sideways whereby the user's neck and spine remain straight without pressing the face into a backrest, the headrest additionally including foldable armrests positionable to comfortably support the recumbent prone user's arms, the headrest also being adaptable for use as a conventional adjustable backrest for sitting and recumbent supine users. In this regard, the present invention substantially fulfills this need.

As illustrated by the background art, efforts are continuously being made in an attempt to develop devices for supporting a person in a sitting or recumbent position. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of lounge chairs now present in the prior art, the present invention provides a new lounge chairs construction wherein the same can be utilized for providing a portable chaise longue with headrest adaptable to support a recumbent prone user's face in a downward position without the necessity of turning the head uncomfortably sideways whereby the user's neck and spine remain straight without pressing the face into a backrest, the headrest additionally including foldable armrests positionable to comfortably support the recumbent prone user's arms, the headrest also being adaptable for use as a conventional adjustable backrest for sitting and recumbent supine users. As such, the general purpose of the present invention, which will be described subsequently in greater detail, is to provide a new foldable lounge with combination headrest and backrest apparatus and method which has all the advantages of the prior art lounge chairs and none of the disadvantages.

The invention is defined by the appended claims with the specific embodiment shown in the attached drawings. For the purpose of summarizing the invention, the invention may be incorporated into a new foldable lounge with combination headrest and backrest for providing a portable chaise longue with a headrest adaptable to support a recumbent prone user's face in a downward position without the necessity of turning the head uncomfortably sideways whereby the user's neck and spine remain straight without pressing the face into a backrest. The headrest additionally includes foldable armrests positionable to comfortably support the recumbent prone user's arms. The headrest is also adaptable for use as a conventional adjustable backrest for sitting and recumbent supine users.

The foldable lounge with combination headrest and backrest comprises a base portion for supporting the lower body of a user. The base portion includes a rectangular frame, constructed of tubular material, separated laterally into a seat portion and a leg rest portion. The frame portions are hingedly connected together such that the leg rest portion may be pivoted upwardly rearwardly to lie adjacent the seat portion when inoperative and may also be pivotally extendable to lie essentially coplanar the seat portion during use. The base portion additionally includes a first U-shaped leg member, constructed of tubular material, cooperatively hingedly connected to the hinged connection of the frame portions such that the first leg member may be pivoted to lie adjacent the seat portion when inoperative. The first leg member may also be pivotally extended downwardly at a slight angle from the frame during use. A second U-shaped leg member, constructed of tubular material, is hingedly connected to the end of the seat portion such that it may be pivoted to lie adjacent the seat portion when inoperative. The second leg member is also pivotally extendable downwardly at a slight angle from the frame during use whereby, in combination with the first leg member, the base frame may be elevated above, and essentially parallel to, a supporting surface. The base portion of the new foldable lounge further includes support means comprising a plurality of closely spaced apart resilient straps stretched laterally across the rectangular frame. The straps form a resilient, essentially planar, surface whereupon the lower body of the user may be comfortably supported.

The foldable lounge also includes a backrest portion to support, in a generally upright position, the upper body of the user seated on the base portion. The backrest portion is also adaptable to support, in a generally horizontal position, the upper body of a supine user and the face and arms of a prone user. The backrest portion has a rectangular backrest frame, constructed of tubular material, hingedly connected at one end thereof to the end of the base frame seat portion such that the backrest frame may be pivoted forward downward to lie adjacent the seat portion when inoperative. The backrest frame is also pivotally settable to any of a plurality of discrete angular positions relative to the plane of the seat portion ranging from a lowest position, essentially coplanar the seat portion for supporting supine and prone users, to a highest position, essentially normal the seat portion for supporting seated users. The backrest frame also has two identical hingedly connected U-shaped extension members, one projecting laterally from each side thereof. The extension members are positionable in a first position, coplanar with the backrest frame, for use as a conventional backrest for supporting seated and supine users. The extension members are additionally pivotable to a downwardly sloping second position, relative to the backrest frame, for supporting the arms of a prone user. The backrest portion of the new lounge also has cushioning means for relieving pressure from the back of a seated or supine user. The cushioning means is also adaptable to receive the downwardly positioned face and pronated arms of a prone user. The cushioning means comprises an identical pair of spaced apart resilient elongated backrest pads fixedly attached to the backrest frame such that the backrest pads lie between the user and the backrest frame. The backrest pads are oriented longitudinal the base portion and spaced apart to contact and support the back of seated and supine users. The backrest pads are also spaced apart to contact and support the sides of a prone user's face such that the nose, mouth, and eyes project downwardly therebetween. The cushioning means also includes a resilient elongated arm pad fixedly attached to the end of both extension members. These arm pads provide additional back support when the extension members are in the first position and are adaptable to support a prone user's arms when the extension members are in the second position. The arm pads are oriented parallel with the backrest pads.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a foldable lounge with combination headrest and backrest for providing a portable chaise longue with headrest adaptable to support a recumbent prone user's face in a downward position without the necessity of turning the head uncomfortably sideways whereby the user's neck and spine remain straight without pressing the face into a backrest.

It is another object of the present invention to provide a new foldable lounge with combination headrest and backrest which may be easily and efficiently manufactured and marketed.

It is a further object of the present invention to provide a new foldable lounge with combination headrest and backrest which is of a durable and reliable construction.

An even further object of the present invention is to provide a new foldable lounge with combination headrest and backrest which is susceptible of a low cost of manufacture with regard to both materials and labor, and which accordingly is then susceptible of low prices of sale to the consuming public, thereby making such lounges with combination headrest and backrests economically available to the buying public.

Still yet another object of the present invention is to provide a new foldable lounge with combination headrest and backrest which provides in the apparatuses and methods of the prior art some of the advantages thereof, while simultaneously overcoming some of the disadvantages normally associated therewith.

Still yet another object of the present invention is to provide a new foldable lounge with combination headrest and backrest that additionally includes armrests positionable to comfortably support a recumbent prone user's arms.

Yet another object of the present invention is to provide a new foldable lounge with combination headrest and backrest that is suitable for sunbathing at the beach or pool side.

Even still another object of the present invention is to provide a new foldable lounge with combination headrest and backrest that is self-contained for ease of transport and use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof, Such description makes reference to the annexed drawings wherein:

FIG. 1 is a perspective view of a prior art lounge with an added head rest.

FIG. 2 is a perspective view of a conventional folding lawn chair with a prior art detachable head rest.

FIG. 5 is a perspective detail view of the backrest portion of the invention of FIG. 3.

FIG. 6 is a rear elevational view of the invention of FIG. 5 illustrating its manner of construction.

DESCRIPTION OF THE PREFERRED EMBODIMENT

Figure 3:
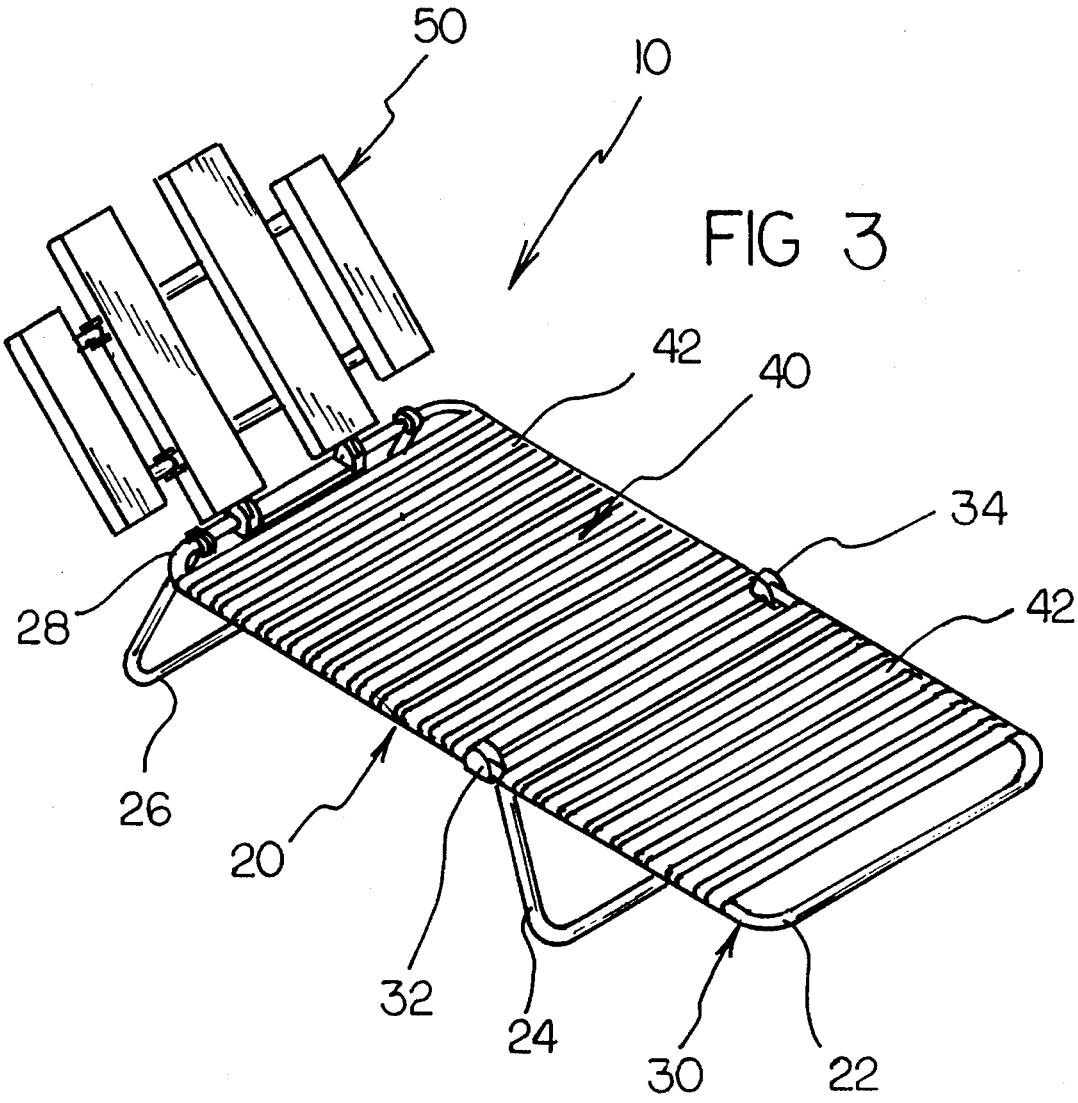
FIG. 3 is a perspective view of the new foldable lounge with combination headrest and backrest.
Figure 4:
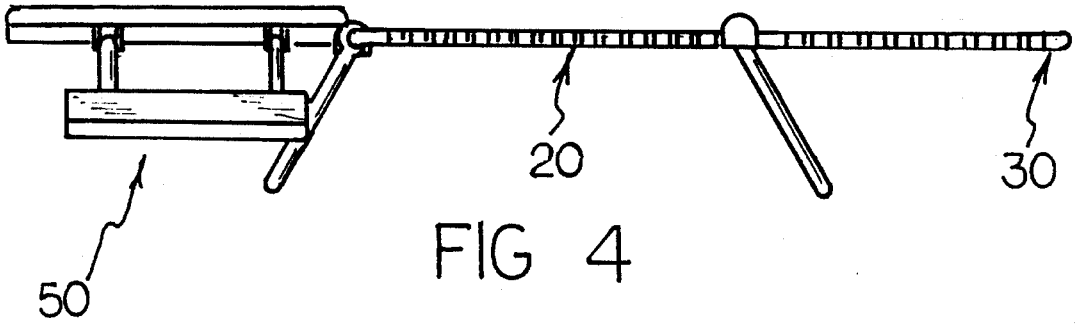
FIG. 4 is a right side elevational view of the invention of FIG. 3.
Figure 7:
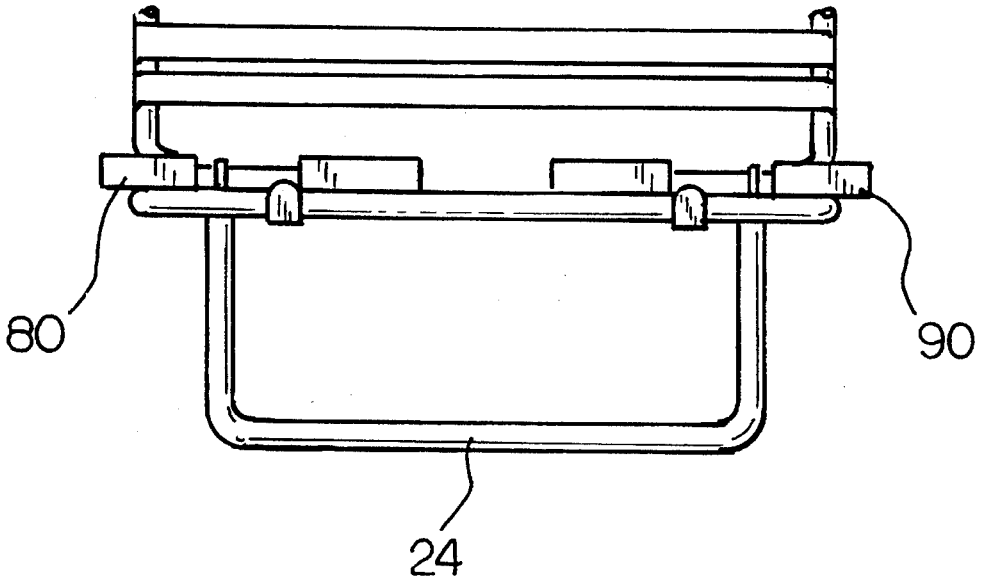
FIG. 7 is a top plan view of the invention of FIG. 6 showing the arm rests positioned for use as a backrest for a seated user.
Figure 8:
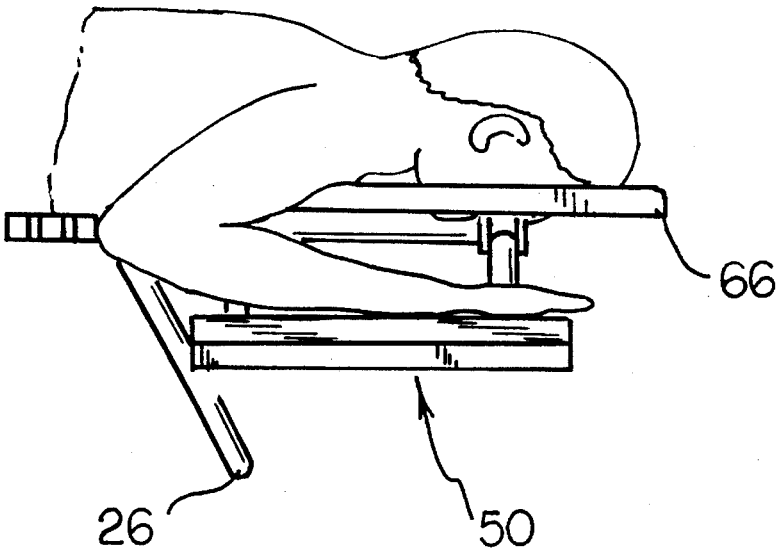
FIG. 8 is a partial left side elevational view of the present invention showing its manner of use by a recumbent prone user.

With reference now to the drawings, and in particular to FIG. 3 thereof, a new foldable lounge with combination headrest and backrest embodying the principles and concepts of the present invention and generally designated by the reference numeral 10 will be described.

From an overview standpoint, the foldable lounge with combination headrest and backrest is adapted for use for providing a portable chaise longue with headrest adaptable to support a recumbent prone user's face in a downward position without the necessity of turning the head uncomfortably sideways whereby the user's neck and spine remain straight without pressing the face into a backrest, the headrest additionally including foldable armrests positionable to comfortably support the recumbent prone user's arms, the headrest also being adaptable for use as a conventional adjustable backrest for sitting and recumbent supine users. See FIG. 3.

With reference now to FIGS. 3–8 and more specifically, it will be noted that a new foldable lounge with combination headrest and backrest is shown. The foldable lounge 10 comprises a base portion 20 for supporting the lower body of a user. The base portion 20 includes a rectangular frame 30, constructed of tubular material, separated laterally into a seat portion 28 and a leg rest portion 22. The frame portions 28 and 22 are connected together with hinges 32 and 34 such that the leg rest portion 22 may be pivoted upwardly rearwardly to lie adjacent the seat portion 28 when inoperative and may also be pivotally extendable to lie essentially coplanar the seat portion during use.

The base portion 20 additionally includes a first U-shaped leg member 24, constructed of tubular material, cooperatively hingedly connected to the hinged connection 32 and 34 of the frame portions 22 and 28 such that the first leg member 24 may be pivoted to lie adjacent the seat portion 28 when inoperative. The first leg member 24 may also be pivotally extended downwardly at a slight angle from the frame 30 during use. A second U-shaped leg member 26, also constructed of tubular material, is hingedly connected to the end of the seat portion 28 such that it may be pivoted to lie adjacent the seat portion 28 when inoperative.

The second leg member 26 is also pivotally extendable downwardly at a slight angle from the frame 30 during use whereby, in combination with the first leg member 24, the base frame 30 may be elevated above, and essentially parallel to, a supporting surface. The base portion 20 of the new foldable lounge 10 further includes support means 40 comprising a plurality of closely spaced apart resilient straps 42 stretched laterally across the rectangular frame 30. The straps 42 form a resilient, essentially planar, surface whereupon the lower body of the user may be comfortably supported.

The foldable lounge 10 also includes a backrest portion 50, best illustrated in FIGS. 5 and 6, to support in a generally upright position the upper body of the user seated on the base portion 20. The backrest portion 50 is also adaptable to support, in a generally horizontal position, the upper body of a supine user and the face and arms of a prone user. The backrest portion 50 has a rectangular backrest frame 62, constructed of tubular material, connected at one end thereof with a hinge 44 to the end of the base frame seat portion 28 such that the backrest frame 62 may be pivoted forward downward to lie adjacent the seat portion 28 when inoperative.

The backrest frame 62 is also pivotally settable to any of a plurality of discrete angular positions relative to the plane of the seat portion 28 ranging from a lowest position, essentially coplanar the seat portion for supporting supine and prone users, to a highest position, essentially normal the seat portion for supporting seated users. The backrest frame 62 also has two identical hingedly connected U-shaped extension members 80 and 90, one projecting laterally from each side thereof. The extension members 80 and 90 are positionable in a first position coplanar with the backrest frame 62, for use as a conventional backrest for supporting seated and supine users. The extension members 80 and 90 are additionally pivotable by way of a conventional hinge 70 to a downwardly sloping second position relative to the backrest frame 62, for supporting the arms of a prone user.

The backrest portion 50 of the new lounge 10 also has cushioning means 60 for relieving pressure from the back of a seated or supine user. The cushioning means is also adaptable to receive the downwardly positioned face and pronated arms of a prone user. The cushioning means 60 comprises an identical pair of spaced apart resilient elongated backrest pads 64 and 66 fixedly attached to the backrest frame 62 such that the backrest pads 64 and 66 lie between the user and the backrest frame. The backrest pads 64 and 66 are oriented longitudinal the base portion 20 and spaced apart to contact and support the back of seated and supine users. The backrest pads 64 and 66 are also spaced apart to contact and support the sides of a prone user's face such that the nose, mouth, and eyes project downwardly therebetween.

The cushioning means 60 also includes a resilient elongated arm pad 84 and 94 fixedly attached to the end of both extension members 80 and 90. The arm pads 84 and 94 provide additional back support when the extension members 80 and 90 are in the first position and are adaptable to support a prone user's arms when the extension members are in the second position. The arm pads 84 and 94 are oriented parallel with the backrest pads 64 and 66.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

Now that the invention has been described,

What is claimed is:

1. A new foldable lounge for providing a portable chaise lounge with a headrest adaptable to support a recumbent prone user's face in a downward position without the necessity of turning the head sideways whereby the user's neck and spine remain straight without pressing the face into a backrest, the headrest additionally including foldable armrests positionable to comfortably support the recumbent prone user's arms, the foldable lounge comprising:

a base portion for supporting the lower body of a user, the base portion comprising: a rectangular frame constructed of tubular material separated laterally into a seat portion with an end and a leg rest portion, the seat portion and the leg rest portion being hingedly connected together to lie adjacent the seat portion when inoperative, the leg rest portion also being pivotally extendable to lie essentially coplanar the seat portion during use; a first U-shaped leg member constructed of tubular material cooperatively hingedly connected to the hinged connection of the frame portions such that the first leg member may be pivoted to lie adjacent the seat portion when inoperative, the first leg member also being pivotally extendable downwardly at a slight angle from the frame during use; a second U-shaped leg member constructed of tubular material hingedly connected to the end of the seat portion such that the second leg member may be pivoted to lie adjacent the seat portion when inoperative, the second leg member also being pivotally extendable downwardly at a slight angle from the frame during use whereby, in combination with the first leg member, the frame may be elevated above and essentially parallel to a supporting surface; support means comprising a plurality of closely spaced apart resilient straps stretched laterally across the rectangular frame, the strap forming a resilient essentially planar surface whereupon the lower body of the user may be comfortably supported; and a backrest portion for supporting in a generally upright position the upper body of the user seated on the base portion, the backrest portion adaptable for supporting in a generally horizontal position the upper body of a supine user, the backrest portion also adaptable for supporting in a generally horizontal position the face and arms of a prone user, the backrest portion comprising: a rectangular backrest frame constructed of tubular material hingedly connected at one end thereof to the end of the base frame seat portion such that the backrest frame may be pivoted forward downward to lie adjacent the seat portion when inoperative, the backrest frame also being pivotally movable to any of a plurality of discrete angular positions relative to the plane of the seat portion ranging from a lowest position essentially coplanar the seat portion for supporting supine and prone users to a highest position essentially normal the seat portion for supporting seated users, the backrest frame having a hingedly connected U-shaped extension member projecting laterally from both sides thereof, the extension members being identical to each other, the extension members being positionable in a first position coplanar with the backrest frame for use as a conventional backrest for supporting seated and supine users, the extension members additionally being pivotable to a downwardly sloping second position relative to the backrest frame for supporting the arms of prone users; cushioning means for relieving pressure from the back of a seated or supine user, the cushioning means also adapted to receive the downwardly positioned face and pronated arms of a prone user, the cushioning means comprising an identical pair of spaced apart resilient elongated backrest pads fixedly attached to the backrest frame such that the backrest pads lie between the user and the backrest frame, the backrest pads being oriented longitudinal with respect to the base portion and spaced apart to contact and support the back of seated and supine users, the backrest pads also being spaced apart for contacting and supporting the sides of a prone user's face such that the nose, mouth, and eyes may project downwardly therebetween, the arm pads being oriented parallel with the backrest pads and the cushioning means also including a resilient elongated arm pad fixedly attached to the end of both extension members for providing additional back support when the extension members are in the first position, the arm pads being adaptable to support a prone user's arms when the extension members are in the second position.

2. A new foldable lounge for providing a portable chaise lounge with a backrest adaptable to support a recumbent prone user's face in a downward position, the backrest additionally including foldable armrests coupled to the backrest to support the recumbent prone user's arms, the foldable lounge comprising:

a base portion for supporting the lower body of a user, the base portion comprising: a rectangular frame separated longitudinally into a seat portion and a leg rest portion; leg means coupled to the frame whereby the frame may be elevated above and essentially parallel to a supporting surface; support means coupled to the frame whereupon the lower body of the user may be supported;

a backrest portion for supporting in a generally upright position the upper body of the user seated on the base portion, the backrest portion comprises a rectangular backrest frame which is pivotally coupled to the base portion for supporting in a generally horizontal position the upper body of a supine user, the backrest frame including a hingedly connected U-shaped extension member projecting laterally from both sides of said backrest frame, the extension members being positionable in a first position coplanar with the backrest frame for use as a conventional backrest for supporting seated and supine users, the extension members additionally being pivotable to a downwardly sloping second position relative to the backrest frame for supporting the arms of prone users; and cushioning means on the surface of the backrest portion for relieving pressure from the back of a seated or supine user and for relieving pressure from the downwardly positioned face and pronated arms of a prone user.

3. The foldable lounge of claim 2 wherein, the base frame portions are hingedly connected together such that the leg rest portion may be pivoted upwardly rearwardly to lie adjacent the seat portion when inoperative, the leg rest portion also being pivotally extendable to lie essentially coplanar the seat portion during use.

4. The foldable lounge of claim 3 wherein the leg means comprises a first U-shaped leg member cooperatively hingedly connected to the hinged connection of the frame portions such that the first leg member may be pivoted to lie adjacent the seat portion when inoperative, the first leg member also being pivotally extendable downwardly at a slight angle from the frame during use; and a second U-shaped leg member hingedly connected to the end of the seat portion such that the second leg member may be pivoted to lie adjacent the seat portion when inoperative, the second leg member also being pivotally extendable downwardly at a slight angle from the frame during use.

5. The foldable lounge of claim 4 wherein the backrest frame is hingedly connected at one end thereof to the end of the base frame seat portion such that the backrest frame may be pivoted forward downward to lie adjacent the seat portion when inoperative, the backrest frame also being pivotally settable to any of a plurality of discrete angular positions relative to the plane of the seat portion during use.

6. The foldable lounge of claim 2 wherein, the cushioning means comprises an identical pair of spaced apart resilient elongated backrest pads fixedly attached to the backrest frame such that the backrest pads lie between the user and the backrest frame, the backrest pads being oriented longitudinal the base portion and spaced apart to contact and support the back of seated and supine users, the backrest pads also being spaced apart to contact and support the sides of a prone user's face, the cushioning means also including a resilient elongated arm pad fixedly attached to the end of both extension members, the arm pads being oriented parallel the backrest pads.

7. The foldable lounge of claim 6 wherein the support means comprises a plurality of closely spaced apart resilient straps stretched laterally across the rectangular base frame, the straps forming a resilient essentially planar surface.

* * * * *